US005499937A

United States Patent [19]

Stevens et al.

[11] Patent Number: 5,499,937

[45] Date of Patent: Mar. 19, 1996

[54] CATHODE FOR HIGH INTENSITY DISCHARGE LAMP

[76] Inventors: John L. Stevens, 40 Winslow Dr., Dunbarton, N.H. 03045; Dale A. Strassner, 4 Simpson Ave., Pembroke, N.H. 03275

[21] Appl. No.: 465,080

[22] Filed: Jun. 5, 1995

Related U.S. Application Data

[62] Division of Ser. No. 299,718, Sep. 1, 1994, Pat. No. 5,451, 837.

[51] Int. Cl.[6] ..... H01J 9/02

[52] U.S. Cl. ..... 445/49; 445/46

[58] Field of Search ..... 445/49, 46, 35

[56] References Cited

U.S. PATENT DOCUMENTS

| | | | |
|---|---|---|---|
| 2,046,981 | 7/1936 | Vars | 445/46 |
| 3,201,849 | 8/1965 | Voss | 445/49 |
| 4,847,534 | 7/1989 | Der Kinderen et al. | 445/46 |
| 4,952,841 | 8/1990 | Coomans et al. | 313/631 |
| 5,001,397 | 3/1991 | Der Kinderen | 445/46 |

FOREIGN PATENT DOCUMENTS

| | | | |
|---|---|---|---|
| 2-86026 | 3/1990 | Japan | 445/46 |

*Primary Examiner*—P. Austin Bradley
*Assistant Examiner*—Jeffrey T. Knapp
*Attorney, Agent, or Firm*—William H. McNeill

[57] ABSTRACT

A cathode for a discharge lamp comprises a longitudinally extending central core of a high temperature, electrically conductive metal; and a coil of high temperature, electrically conductive metal wound thereabout, said coil being fastened to said core at least in part by mechanical interference. The mechanical interference can be achieved by keyways formed in the core surface. During winding, at least some of the turns of the coil enter the keyways providing a good, mechanical engagement of the coil with the core. The keyways can be formed by heating the core and compressing or forging areas with tools or the keyways can be formed by grinding or by any other suitable means.

2 Claims, 3 Drawing Sheets

CATHODE FOR HIGH INTENSITY DISCHARGE LAMP

This is a division of application Ser. No. 08/299,718, filed on Sep. 1, 1994, now U.S. Pat. No. 5,451,837.

TECHNICAL FIELD

This invention relates to lamp cathodes and more particularly to such cathodes for high intensity discharge lamps.

BACKGROUND ART

Cathodes for high intensity discharge lamps generally comprise a rod or core of a refractory metal, such as tungsten that may include a small percentage of thoria and which has a coil of tungsten or tungsten doped with thoria wound thereabout. The coil, which may be a coiled coil or a coiled, coiled coil, as known in the art, is generally wound upon a mandrel, separated therefrom, and subsequently arranged upon its appropriate core, which is fitted into the coil by virtue of having a diameter slightly less than the interior diameter of the coil. The core and coil are then fixtured and the inner layer of the coil is crimped to the core. By passing a current through the crimp area the formability of the coil and core material is improved and the coil windings deform and embed slightly in the core, making a mechanical lock with some degree of weld in evidence.

This procedure can achieve temperatures that cause recrystallization of the materials and damages the integrity of the assembly. This damage is known to cause failures in downstream operations as well as in finished lamps. Further, the apparatus presently in use has problems dealing with the smaller cathodes that would be required for lower wattage lamps.

It has been proposed to eliminate some of these problems by winding the coil directly on its appropriate core. Such a solution is shown in U.S. Pat. No. 4,952,841; however, this system requires welding the coil to the core, an extra operation that increases the cost of the cathode and causes recrystallization.

SUMMARY OF THE INVENTION

It is, therefore, an object of the invention to obviate the disadvantages of the prior art.

It is another object of the invention to enhance the manufacture of lamp cathodes.

Yet another object of the invention is the provision of a lamp cathode that can be manufactured in small sizes.

These objects are accomplished, in one aspect of the invention, by a cathode for a discharge lamp which comprises a longitudinally extending central core of a high temperature, electrically conductive metal; and a coil of high temperature, electrically conductive metal wound thereabout, said coil being fastened to said core at least in part by mechanical interference.

As used herein, the term "mechanical interference," refers to fastening by friction or key and keyway techniques, as will become clear hereinafter.

The use of mechanical interference avoids the high heat previously employed, thus avoiding the recrystallization problems and obviating the need for welding or crimping.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
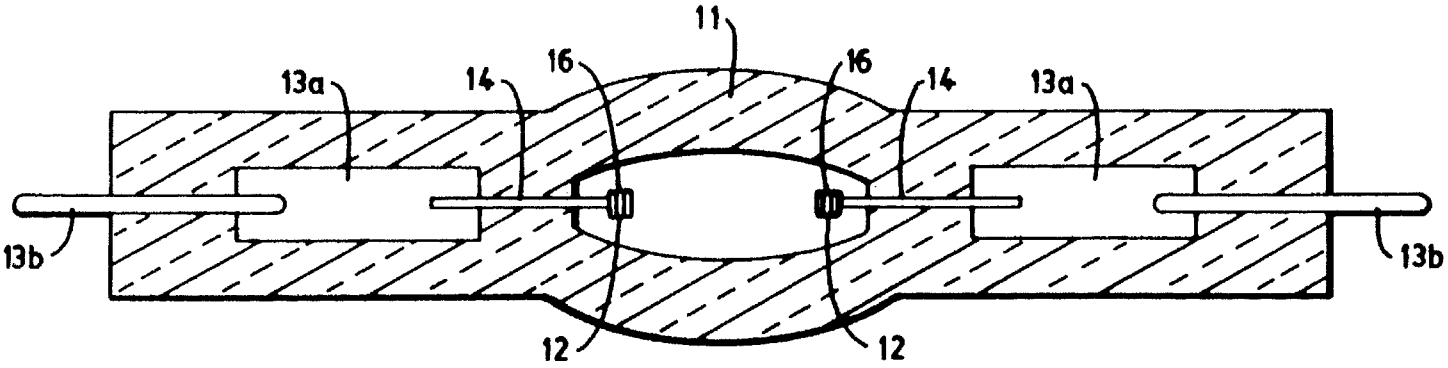
FIG. 1 is a sectional, elevational view of a lamp which can employ the invention.

Referring now to the drawings with greater particularity, there is shown in FIG. 1 a high pressure discharge lamp having a quartz glass envelope 11 sealed in a vacuum-tight manner and containing an arc generating and sustaining medium therewithin. Cathodes 12 are connected to current supply conductors 13*a*, 13*b* projecting beyond the envelope 11. A cathode core 14 projects inside the envelope and has a coil 16 affixed thereto.

Figure 2:
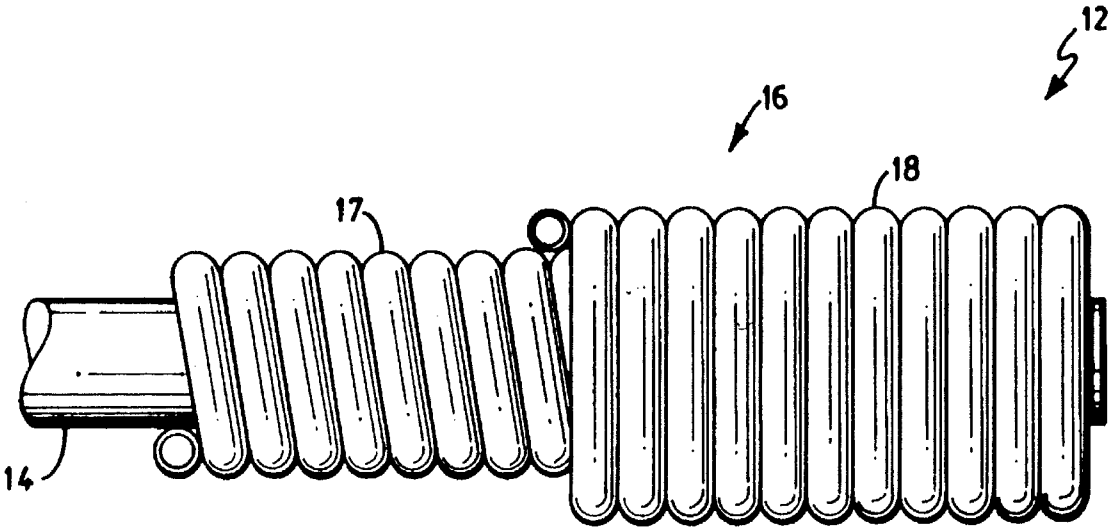
FIG. 2 is an enlarged elevational view of a cathode.

Cathode 12 is shown in an enlarged view in FIG. 2 as comprising the core 14 which can be cylindrical and have a given diameter, and which has a coil 16, which can be a coiled coil having an inner layer 17 and an outer layer 18.

Figure 3:
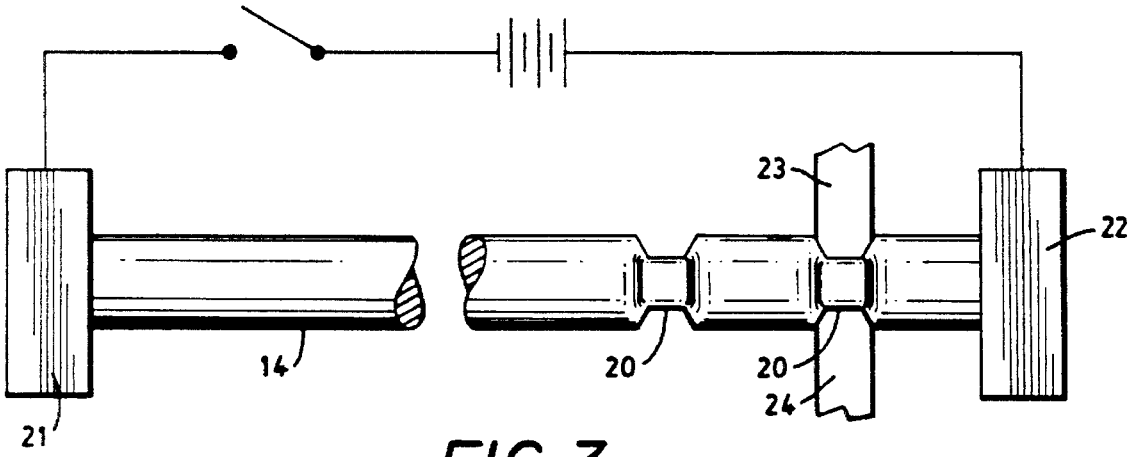
FIG. 3 is a diagrammatic elevational view of a method of making a cathode of the invention.

The coil 16 is affixed to the core 14 by mechanical interference which can be achieved by providing the core 14 with one or more keyways 20 as shown in FIG. 3. In the latter figure, a section of core 14 is mounted between electrodes 21 and 22 and an electric current is applied thereto to cause heating. Of course, other means of heating, such as conduction, can also be employed. Tools 23 and 24 acting in compression form the keyways 20 in the heated core. The temperature of the core should not exceed 1400° C. to avoid the recrystallization problems of the prior art: however, in the preferred embodiment the temperature should not exceed about 370° C. (700° F.) as greater temperatures may increase the ductility of the core to the point that its gross shape may be affected by the forging process. Also, even in a purged atmosphere, the threat of oxidation increases with increasing temperature.

Figure 4:
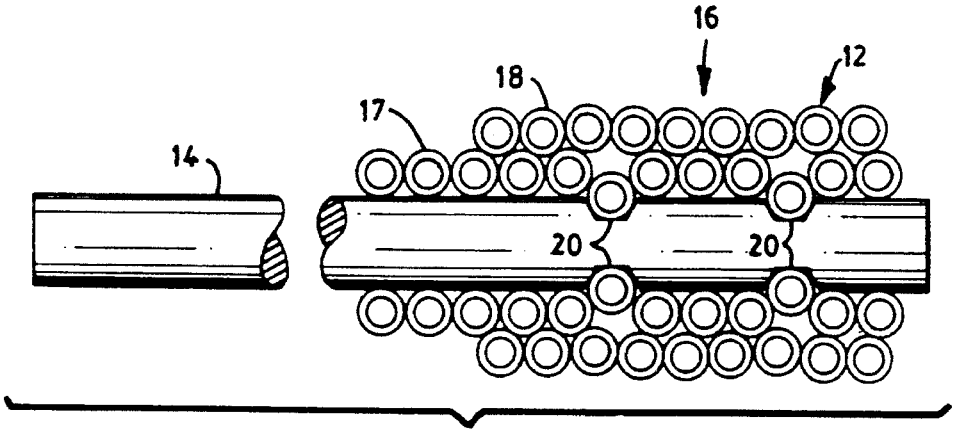
FIG. 4 is an elevational view, partly in section, of a cathode of the invention.

FIG. 4 illustrates the manner in which the coil being wound on the core 14 provides this interference fit as some of the individual turns of the coil fall into the keyways 20.

Figure 5:
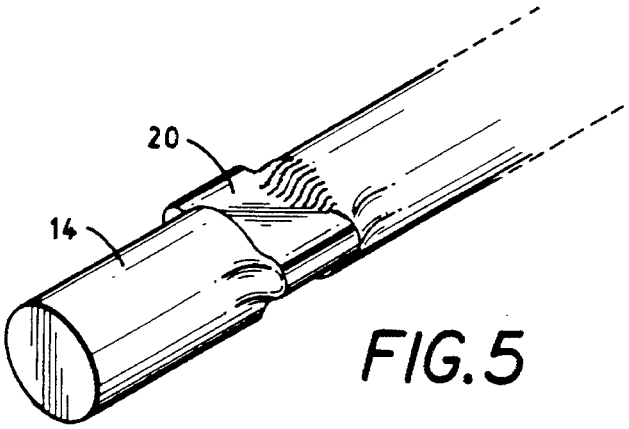
FIG. 5 is a perspective view of a core made in accordance with FIG. 3.

The partial perspective view of FIG. 5 illustrates how the formation of the keyways 20 can provided a slight projection of material which also aids in forming the mechanical interference.

Figure 7:
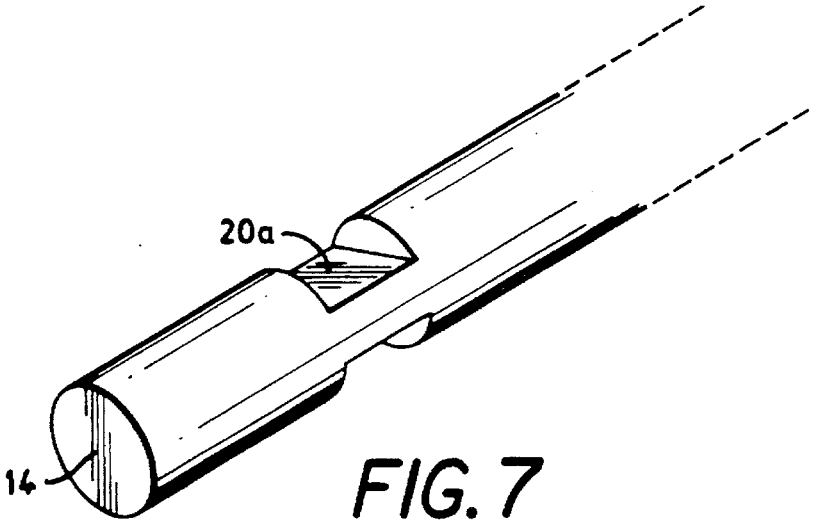
FIGS. 7, 8 and 9 are perspective views of additional embodiments of cores.
Figure 8:
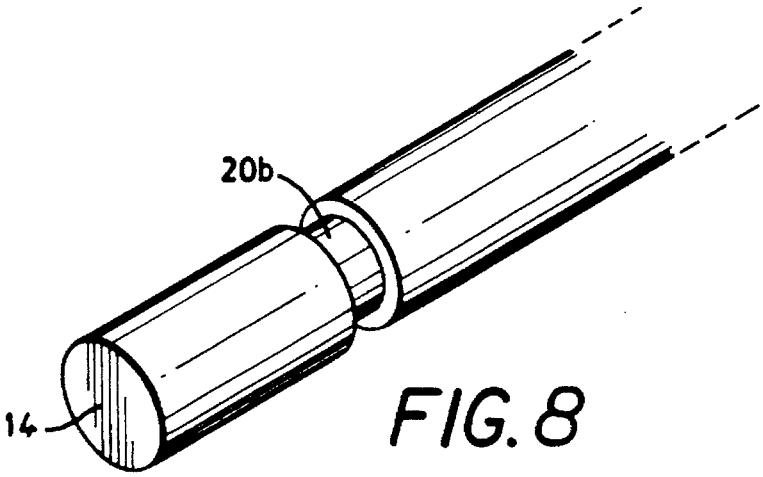

FIG. 7 illustrates a keyway 20*a* which can be formed by grinding on opposite sides of the core 14 (or, alternatively, on one side only) and FIG. 8 shows a mechanical interference provider 20*b* which is circumferential and has a diameter less than the diameter of the core.

Figure 9:
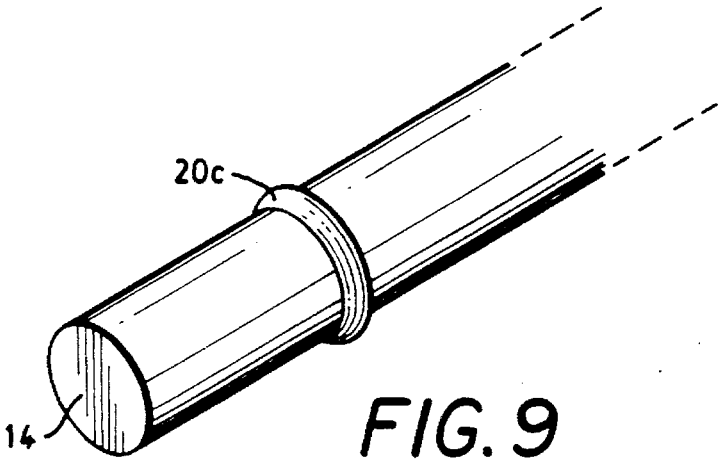

FIG. 9 shows a core 14 wherein the interference provider is in the form of an enlarged diameter 20*c*.

In each of the embodiments described above, subsequent heating of the wound assembly can reinforce the tendency of the materials to relax to their original shape; thus, the coil wound over what amounts to an elliptical shape of the keyway 20 has a tendency to return to the round, further tightening its grip on the core.

Figure 6:
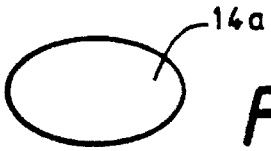
FIG. 6 is end view of an alternate form of core.

Most of the benefits of the invention can also be enjoyed by employing a core having the cross-section of FIG. 6. Therein, a core 14*a* is elliptical or oval for its entire length. This configuration loses the multiple interference points but retains the feature of material relaxation tightening the coil's grip and may offer advantages in fabrication cost.

While there have been shown an described what are at present considered the preferred embodiments of the invention, it will be apparent to those skilled in the art that various changes and modifications can be made herein without departing from the scope of the invention as defined by the appended claims.

What is claimed is:

1. The method of making a cathode for a discharge lamp, said cathode comprising an elongated central core having a coil wound thereabout, comprising the steps of: providing a section of core material; heating said core material; deforming at least a portion of said core by compression; and winding a coil about said core at least over said deformed portion.

2. The method of claim 1 wherein more than one deformed portion is provided.

* * * * *